US006615010B2

(12) United States Patent
Hirabayashi et al.

(10) Patent No.: US 6,615,010 B2
(45) Date of Patent: Sep. 2, 2003

(54) ELECTRIFIER FOR CHARGING DEVELOPER CARRYING MEMBER USING CHARGE PARTICLES, INCLUDING CHARGE ROTARY MEMBER AND NIP FORMING MEMBER HAVING BIAS POLARITY THE SAME AS DEVELOPER POLARITY

(75) Inventors: Jun Hirabayashi, Shizuoka (JP); Harumi Ishiyama, Shizuoka (JP); Yasunori Chigono, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/964,638

(22) Filed: Sep. 28, 2001

(65) Prior Publication Data

US 2002/0061207 A1 May 23, 2002

(30) Foreign Application Priority Data

Oct. 2, 2000 (JP) ..... 2000-302604

(51) Int. Cl.[7] ..... G03G 15/02
(52) U.S. Cl. ..... 399/174; 399/175; 399/176
(58) Field of Search ..... 399/149, 150, 399/174–176

(56) References Cited

U.S. PATENT DOCUMENTS 5,517,289 A 5/1996 Ito et al.
5,570,451 A 10/1996 Sakaizawa et al.
6,038,418 A * 3/2000 Chigono et al. ..... 399/174
6,038,420 A * 3/2000 Hirabayashi et al. ..... 399/176
6,081,681 A 6/2000 Nagase et al. ..... 399/174
6,128,456 A 10/2000 Chigono et al. ..... 399/176
6,134,407 A 10/2000 Ishiyama et al. ..... 399/174
6,233,419 B1 * 5/2001 Chigono et al. ..... 399/176

FOREIGN PATENT DOCUMENTS

| | | |
|---|---|---|
| JP | 10-307454 | 11/1998 |
| JP | 10-307455 | 11/1998 |
| JP | 10-307456 | 11/1998 |
| JP | 10-307457 | 11/1998 |
| JP | 10-307458 | 11/1998 |
| JP | 10-307459 | 11/1998 |

* cited by examiner

*Primary Examiner*—William J. Royer
(74) *Attorney, Agent, or Firm*—Fitzpatrick, Cella, Harper & Scinto

(57) ABSTRACT

An electrifier for electrifying a member to be charged includes a charge rotary member that forms a first nip with the member to be charged, to charge the member to be charged, and that holds and carries charge particles to the first nip, and a nip forming member that forms a second nip with the charge rotary member, the nip forming member having a bias charge having the same polarity as the developer.

30 Claims, 2 Drawing Sheets

ELECTRIFIER FOR CHARGING DEVELOPER CARRYING MEMBER USING CHARGE PARTICLES, INCLUDING CHARGE ROTARY MEMBER AND NIP FORMING MEMBER HAVING BIAS POLARITY THE SAME AS DEVELOPER POLARITY

BACKGROUND OF THE INVENTION

1. Field of the Invention

The present invention relates to an electrifier for charging to a predetermined polarity or potential a charge target member (image bearing member), such as an electrophotographic photosensitive member or an electrostatic recording dielectric member, and to an image forming apparatus equipped with this electrifier, such as a copier or a printer.

2. Related Background Art

A contact electrification means using charge accelerating particles is disclosed, for example, in Japanese Patent Application Laid-Open Nos. 10-307454 to 10-307459. In this contact electrification means, charge accelerating particles are introduced at a charge nip, which comprises the contact portions of a charge target member and a contact charge member (hereinafter referred to as a charge roller) that is generally provided as a roller member and that contacts the target charge member, so that an injection charging mechanism dominates a discharge charging mechanism.

The charge accelerating particles are conductive particles used as auxiliary means for charging. The charge accelerating particles can be arbitrary conductive particles, including particles of a metal oxide such as conductive oxide zinc, or particles of other conductive inorganic materials or organic material mixtures, having a diameter of 0.1 to 5 $\mu$m, for example, and a volume resistivity equal to or lower than $1\times10^{12}$ $\Omega\cdot$cm, or more preferably, equal to or lower than $1\times10^{10}$ $\Omega\cdot$cm.

Because of the presence of the charge accelerating particles at the charge nip, the speed of the charge roller constituting the contact charge member can differ from that of the target charge member it contacts. At the same time, since the charge roller closely contacts the target charge member via the charge accelerating particles, charge failures due to insufficient contact seldom occur. That is, since there is no intervening gap separating the charge accelerating particles from the target charge member at the nip, a preferable charging property is obtained by rubbing the charge accelerating particles that are present against the surface of the target charge member, thereby directly injecting an electric charge into the target charge member (injection charging). In other words, because of the presence of the charge accelerating particles, the dominant process performed by the injection and charging mechanism is the electrification of the target charge member using the charge roller.

Therefore, electrification efficiency is increased, an objective that can not be achieved with the conventional roller charging, a voltage substantially as high as the voltage carried by the charge roller, which is the contact charge member, can be applied to the target charge member, and only a simple structure is required to implement ozonless injection charging at a low applied voltage. Injection charging is effective as the charging means for an electrophotographic image forming apparatus or an electrostatic image forming apparatus, and provides a uniform charge having a predetermined polarity and potential for an image bearing member, such as an electrophotographic photosensitive member or an electrostatic recording dielectric member.

Further, for injection charging for which the charge accelerating particles are used, a cleaner-less image forming apparatus can uniformly electrify an image bearing member (hereinafter referred to as a photosensitive member) constituted by a target charge member. As part of a specific configuration, the charge accelerating particles are mixed with a developer (hereinafter referred to as toner), and at a developing portion, this mixture is supplied by a developing device to the surface of the photosensitive member. At a transfer portion, primarily only the toner is transferred to a transferring material, while the charge accelerating particles are supplied to a charge nip at the portion whereat the contact charge member contacts the photosensitive member. As a result, in a cleaner-less image forming apparatus, ejection charging makes it possible to uniformly electrify a photosensitive member. A configuration whereby charge accelerating particles are supplied by developing means to the charge nip at the portion whereat the contact charge member contacts the photosensitive member is disclosed in Japanese Patent Application Laid-Open No. 10-307455, for example.

As the photosensitive member is sequentially rotated, following the transfer process residual toner reaches the developing portion via the electrification means, and is removed (collected) from the surface of the photosensitive member by the developing device at the same time as the developing is performed (toner recycle process).

A well known cleaning process that is performed simultaneously with the development of an image is one where, at the succeeding development process during the image forming, i.e., during the process for continuously electrifying and exposing the photosensitive member to form and to develop a latent image, toner remaining on the photosensitive drum following the transfer process is collected by employing a fogging removal bias, i.e., a fogging removal potential difference Vback constituting a potential difference between a direct-current voltage applied to the developing device and the surface potential of the photosensitive member (Japanese Patent Application Laid-Open No. 10-307456).

Since the charge accelerating particles intervene at the charge nip, the abutting pressure applied between the charge roller and the photosensitive member can be increased, while the contact torque of the charge roller is reduced and the residual transfer developer does not pass through the charge nip between the charge roller and the photosensitive member.

In the above described system, personified by a transfer type cleaner-less image forming apparatus that employs, as means for electrifying an image bearing member, contact charge means that uses the charge accelerating particles, where a residual transfer developer is carried to the contact charge means, not only must the image bearing member be electrified, appropriate electric charges must also be provided for the residual transfer developer. When appropriate charges are not provided for the residual transfer developer, the developer cannot be collected by the developing device, and an image having a satisfactory quality cannot be obtained.

SUMMARY OF THE INVENTION

It is one objective of the present invention to provide an electrifier that uses charge particles to perform electrification satisfactorily, and an image forming apparatus therefor.

It is another objective of the present invention to provide an electrifier that applies appropriate electric charges to the developer on a charged rotary member, and an image forming apparatus therefor.

It is an additional objective of the present invention to provide an image forming apparatus that controls the electrical charges held by the developer. on a charged rotary member, so as to provide increased efficiency for the collection, by a developing device, of the developer on an image bearing member.

The other objectives and features of the invention will become more apparent during the course of the following detailed explanations of the preferred embodiments, given while referring to the accompanying drawings.

DETAILED DESCRIPTION OF THE PREFERRED EMBODIMENTS (Embodiment 1)

Figure 1:
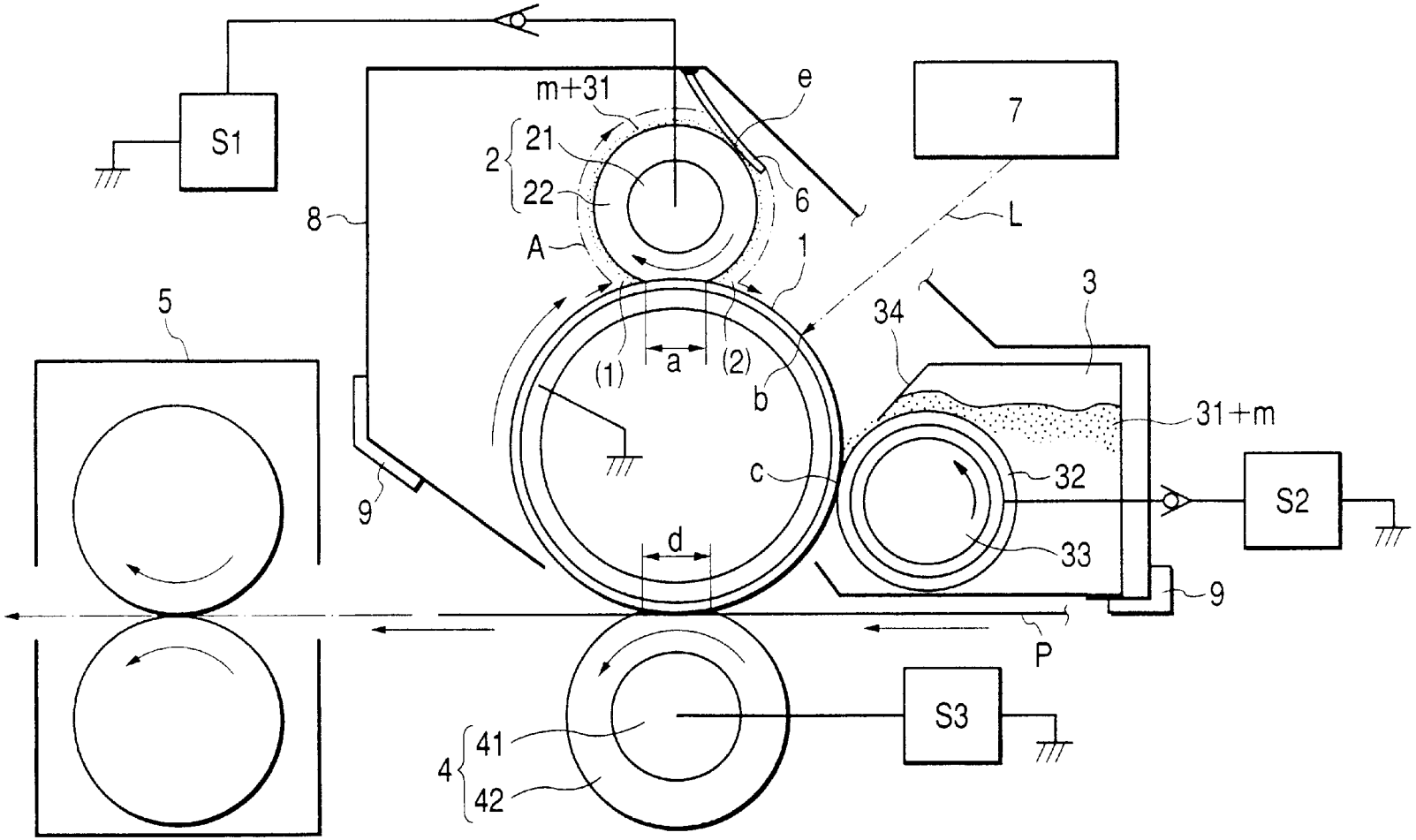
FIG. 1 is a schematic diagram showing the specific configuration of an image forming apparatus according to a first embodiment of the present invention.

FIG. 1 is a schematic diagram showing a specific configuration for an image forming apparatus according to a first embodiment of the present invention. The image forming apparatus of this embodiment is a laser beam printer, employing a transfer-type electrophotographic process, of an injection charge type that uses charge accelerating particles, an inversion development type, a cleaner-less (toner recycling) type, and a process cartridge type.

(1) Schematic General Configuration of a Printer

An electrophotographic negative photosensitive member (hereinafter referred to as a photosensitive member) 1 is a rotary drum, having a diameter of 30 mm, that serves as an image bearing holder. The photosensitive member 1 is rotated clockwise, in the direction indicated by an arrow, at a peripheral speed of 94 mm/sec.

Electrification Process:

During the rotation of the photosensitive member 1, while a charge roller 2 is used as a contact charge member, an electrifier using charge accelerating particles m performs the injection charge process uniformly, at a predetermined polarity and potential, and directly for the outer surface of the photosensitive member 1 at a charge position (=charge nip) a. In this embodiment, the photosensitive member 1 is uniformly charged substantially at −700 V.

The charge accelerating particles m are coated in advance on the surface of the charge roller 2, and a silicone rubber nip forming member 6, shaped like a sheet, is arranged so that it contacts the charge roller 2.

The charge roller 2, the charge accelerating particles m, the injection charge process and the nip forming member 6 will be described in detail later in subdivision (2).

Image Exposure Process:

The uniformly charged face of the photosensitive member 1 is exposed to a laser beam L at an exposure position b by a laser beam scanner 7, an information writing means, and an electrostatic latent image is formed in accordance with an object print pattern (image information).

The laser beam scanner 7, which includes a laser diode polygon mirror, outputs the laser beam L, having an intensity that is modulated in accordance with the time-series electric digital pixel signal of a print signal, and scans the uniformly charged face of the photosensitive member 1 using the laser beam L (exposes the image portion).

Development Process:

The electrostatic latent image on the photosensitive member 1 is inverted and at a development position c is developed as a toner image by a developing device 3.

The developing device 3 of this embodiment is an inverse developing device that employs for the development process a magnetic, one-component insulating developer 31 (a magnetic, one-component insulating negative toner) for which the diameter of an average particle is 6 $\mu$m and for which the normal polarity is negative. A 16 mm diameter non-magnetic developing sleeve 32 serves as a developer holding and transporting member. A non-rotating magnetic roller 33 is inserted into and enclosed by the developing sleeve 32, which is arranged at a fixed distance of 500 $\mu$m from the surface of the photosensitive member 1 and is rotated counterclockwise, as indicated by an arrow, at the same steady speed as that of the photosensitive member 1. As the developing sleeve 32 is rotated, the developer 31 in the developing device 3 near the developing sleeve 32 is transported by the magnetic charge carried by the magnetic roller 33 and is itself charged (a charge is provided), and its thickness regulated, by the friction produced as it is carried past an elastic developing blade 34 pressed against the developing sleeve 32. Then, the developer 31 is carried to the development position c located between the photosensitive member 1 and the developing sleeve 32.

A predetermined development bias voltage is applied to the developing sleeve 32 by a development bias voltage power source S2. The development bias voltage in this embodiment is a superposition voltage obtained as the algebraic sum of a a DC voltage: −350 V, and an AC voltage: a peak to peak voltage of 1.7 kV and a frequency of 1.6 kHz.

Therefore, a one-component jumping phenomenon occurs between the developing sleeve 32 and the photosensitive member 1, and the developer 31 is selectively attached to the light portion (image portion) of the electrostatic latent image on the photosensitive member 1, thereby inversely developing an electrostatic latent image. It should be noted that the development bias voltage is not limited to the one described above.

As the developer 31 in this embodiment, 60 weight % of magnetite and 1 weight % of a monoazo dye, a metal complex salt that is a negative charge control material, are mixed together with a bonding resin, which contains a styrene acryl copolymer as a primary element, to form an insulating developer having a volume resistivity of about $10^{13}$ Ω·cm, and 0.8 weight % of hydrophobic silica particles are added to the developer to the weight of the developer to provide flowability.

The charge accelerating particles m are mixed with and contained in the developer 31 in an amount having 2 parts by weight relative to a developer 31 having 100 parts by weight. It should be noted that the volume weights per unit specified here do not in any way limit the amounts that can be used. Together with the developer 31, the charge accelerating particles m in the developing device 3 are supplied to the photosensitive member 1 and are carried to the charge nip a while held on the photosensitive member 1.

Transfer process: The toner image on the photosensitive member 1 is transferred to the face of a transferring material (recording material) P at a transferring position (=transferring nip) d of a transferring electrifier.

The transferring electrifier of this embodiment is a transferring roller 4 which, as a transferring member, is obtained by coaxially forming, around a metal core 41, an elastic rubber roller layer 42 having an intermediate resistance. The transferring nip d is then provided by bringing the transferring roller 4 into contact with the photosensitive member 1. The transferring roller 4 of this embodiment has a resistance of $5\times10^8$ Ω.

The recording material P is fed from a paper stack unit (not shown) to the transferring nip d at a predetermined control timing. As the recording material P is held and carried through the transferring nip d, a predetermined transfer bias voltage, a DC voltage of +3000 V, is applied to the transferring roller 4 by a transfer bias voltage power source S3. Thus, the toner image on the photosensitive member 1 is transferred by the electrostatic force and the pressing force to the recording material P that is held and carried through the transferring nip d.

Fixing process: The recording material P passed through the transferring nip d is separated from the photosensitive member 1, and is transmitted to an image fixing device 5. The toner image on the recording material P is fixed by the fixing device 5, and the recording material P is discharged outside the machine as an image carrying material (printed matter or a copy).

The printer of this embodiment is a cleaner-less printer that does not include a special cleaner for an image bearing member. Thus, after the toner image has been transferred to the recording material P at the transferring nip d, the residual toner on the photosensitive member 1 is not removed by a spacial cleaning device (cleaner), and instead, as the photosensitive member 1 continues to be rotated, the residual toner is carried to the charge position a and is temporarily attached to the charge roller 2. The developer 31 is again moved from the charge roller 2 to the photosensitive member 1 and reaches the development position c where it is removed (collected) by the developing device 3 at the same time as the development is performed. Since the photosensitive member 1 is exposed while the developer 31 is present thereon, the electrostatic latent image is formed, and at the development position c, the light portion of the electrostatic latent image is developed, while at the same time the developer 31 is collected from the dark portion of the latent image.

In the printer in this embodiment, three processing units, the photosensitive member 1, the charge roller 2 and the developing device 3, constitute a process cartridge 8 that is detachable and exchangeable relative to the main body of the printer. A process cartridge detachment guide and support member 9 are also provided for the printer.

The process cartridge 8 is a unit wherein, at the least, either the electrification means or the developing means and an image bearing member are integrally formed, so that the cartridge can be detached from the image forming apparatus.

(2) Charge Roller 2, Charge Accelerating Particles m, Injection Charge and Nip Forming Member 6

The charge roller 2 is obtained by forming, on a metal core 21, an intermediate resistant layer 22 made of rubber or a foam material. The intermediate resistant layer 22 is made from a resin (urethane in this embodiment), conductive particles (e.g., carbon black), a sulfide agent and a foaming agent, and is deposited as a roller on the metal core 21. Then, the surface of the layer 22 was polished.

The resistance of the charge roller 2 was measured in the following manner. The photosensitive member 1 of the image forming apparatus was replaced by an aluminum drum, and thereafter, a voltage of 100 V was applied between the aluminum drum and the charge roller 2 and the value of a current flowing at this time was measured.

The obtained resistance of the charge roller 2 in this embodiment was $5\times10^6$ Ω. This measurement was conducted at a temperature of 25° C. and a humidity of 60%. The measurement environment in this embodiment is also employed for another embodiment.

The average cell diameter on the surface of the charge roller 2 was 20 μm for each resistance. This average cell diameter was measured by observation using an optical microscope.

The charge accelerating particles m are coated and held on the outer surface of the charge roller 2, and the charge nip a (the first nip) having a predetermined width is formed by bringing the charge roller 2 into contact with the photosensitive member 1 under a predetermined pressing force.

The charge roller 2 is rotated at a peripheral speed of 100% in the opposite direction (counter direction) at the portion contacting the photosensitive member 1. That is, the charge roller 2 is rotated at a different speed relative to the photosensitive member 1, while the charge bias voltage is applied to the charge roller 2 by a charge bias voltage power source S1 and the outer surface of the photosensitive member 1 is uniformly electrified substantially at −700 V.

The silicone rubber nip forming member 6 having a sheet shape contacts the charge roller 2 in order to form a second nip forming member 6 and the charge roller 2. The nip forming member 6 is made of elastic silicone rubber, and has a hardness of 45° (JISA: JISK6301 A-type testing machine was used), a thickness of 1.4 mm and a free length of 8 mm in order to provide appropriate flexibility. The nip forming member 6 contacts the charge roller 2 in the forward rotation direction of the charge roller 2. The pressure with which the charge roller 2 is contacted is set to about 20 g/cm.

In this embodiment, the charge accelerating particles are conductive zinc oxide particles having a specific resistance of $10^7$ Ω·cm and an average particle diameter of 1 μm. Preferably, the average particle diameter of the charge accelerating particles m is 0.1 to 5 μm, and the specific resistance is equal to or lower than $1\times10^{12}$ Ω·cm, or more preferably, equal to or lower than $1\times10^{10}$ Ω·cm.

When the charge accelerating particles are provided as a cohesive member, the particle diameter is defined as the average diameter of the cohesive member. For the measurement of the particle diameter, 100 or more particles were extracted through observation using an optical or electronic microscope, the volume grain distribution was calculated using the maximum horizontal chord length, and 50% average particle diameter was determined.

The resistance was measured and normalized using the pellet method. A powder sample of about 0.5 g was introduced into a cylinder having a bottom dimension of 2.26 $cm^2$, and a voltage of 100 V was applied to upper and lower electrodes under a pressure of 147 N (15 kg). The resistance at this time was measured and normalized to obtain the specific resistance.

For this embodiment, colorless or white particles are appropriate in order for the charge accelerating particles m not to interfere with the exposure of the latent image. Further, since the image exposure may be interrupted unless the particle diameter is equal to or smaller than ½ of the diameter of the developer 31, the particle diameter of the charge accelerating particles m should be smaller than ½ of the diameter of the developer 31.

In this embodiment, conductive zinc oxide particles are employed as the charge accelerating particles m. However, various other conductive particles can be employed, including conductive inorganic particles, such as metal oxide other than zinc oxide, and a mixture that includes an organic material.

Since in this embodiment the charge accelerating particles m are coated in advance on the charge roller 2, the charging of the apparatus in the initial state is obtained. Further, since the charge accelerating particles m are mixed with the developer 31 in the developing device 3, the charge accelerating particles m from the developing device 3 can be supplied via the surface of the photosensitive member 1 to the charge roller 2, which is the contact charging member for electrifying the photosensitive member 1. In addition, since the silicone rubber nip forming member 6 having the shape of a sheet is brought into contact with the charge roller 2, a contact nip e (second nip) can be formed at a location other than that of the charge nip a between the charge roller 2 and the photosensitive member 1.

Once the contact nip e is formed, contact between the charge accelerating particles m and the residual developer on the charge roller 2 can be improved, and the charge accelerating particles m and the developer 31 can be aggressively charged by friction. Thus, the photosensitive member 1 can be appropriately electrified, and an appropriate electric charge can be provided for the residual developer.

That is, in the present embodiment, the charge accelerating particles m are mixed in the developer 31 in the developing device 3, and the charge accelerating particles m that are mixed in have 2 parts by weight relative to the developer 31 having 100 parts by weight. It should be noted that the amount to be mixed in is not limited to this value.

The charge accelerating particles m are rubbed against the developer 31 in the developing device 3. In this embodiment, since negative charge control material is added to the developer 31, a charge having an opposite polarity, i.e., a positive polarity, is placed on the charge accelerating particles m by the friction between them and developer 31. Therefore, the charge accelerating particles m in the developer 31 attached to the developing sleeve 32 move to the surface of the photosensitive member 1 because of a potential difference between the developing sleeve 32 and the photosensitive member 1. Since the charge accelerating particles m have a polarity that is opposite that of the developer 31, they are not transferred at the transferring nip d, and are supplied to the charge portion a where the charge roller 2 contacts the photosensitive member 1. As a result, the charge accelerating particles m are coated on the surface of the charge roller 2.

Since the charge accelerating particles m are attached to the surface of the charge roller 2 in this manner, they are distributed between the charge roller 2 and the photosensitive member 1 so that the contact density is increased. As a result, a satisfactory charging characteristic can be obtained.

The developer 31 that is not transferred at the transferring nip d remains on the photosensitive member 1 and is carried to the charge position a where the charge roller 2 contacts the photosensitive member 1. Even if an image forming apparatus is employed that includes a member for cleaning the surface of the photosensitive member 1 after the transfer process, the present invention can be applied as in this embodiment because some developer 31 may be present after the cleaning member is passed, even only a slight amount may be involved.

In FIG. 1, an arrow A indicated by a chain line indicates how the residual developer (or the developer that fails to be removed), which is carried to the charge position a where the charge roller 2 contacts the photosensitive member 1, is held on the surface of the charge roller 2. According to the electrification method in this embodiment, the charge roller 2 is rotated to the charge nip a in the direction counter to that of the photosensitive member 1. The developer 31 that has not been transferred at the transferring nip d is carried to a nip position (1) where the charge roller 2 contacts the photosensitive member 1, and is attached to the surface of the charge roller 2. As is indicated by the chain-line arrow A, the residual developer is attracted and attached to the charge roller 2 and carried on the surface of charge roller 2 one full revolution. At position (2), at the entrance to the contact nip formed between the photosensitive member 1 and the charge roller 2, as the rotation of the photosensitive member 1 continues, the residual developer is returned to the surface of the photosensitive member 1, and is carried to the development position c.

The point (1), where the residual developer is transferred from the photosensitive member 1 to the charge roller 2, is located immediately before the contact charge nip a, and substantially no residual developer passes through the contact nip.

The residual developer attracted to the charge roller 2 includes developer carrying only a small electric charge or developer for which the polarity of the charge carried was inverted. Therefore, the appropriate application of charges is required for the residual developer, so that the developing device 3 can collect the residual developer carried to the development position c.

According to the electrification method in this embodiment that uses the charge accelerating particles an electric charge can be applied by bringing the charge accelerating particles m into contact with the developer 31 on the surface of the charge roller 2.

In this embodiment, since the nip forming member 6 contacts the charge roller 2, the charge accelerating particles m and the developer 31 closely contact each other, so that an appropriate negative (normal polarity) charge can be applied to the residual developer.

For the configuration in this embodiment wherein the nip forming member 6 contacts the charge roller 2 and the configuration (hereinafter referred to as the conventional example) wherein the nip forming member 6 is not provided, an experiment was conducted to examine the difference in the charges applied to the residual developer on the charge roller 2 that was returned to the photosensitive member 1 at point (2). The results obtained are shown below.

The toner charge is indicated by the unit "charge ($\mu$C)/weight (mg)", both for the embodiment and the conventional example.

TABLE 1

| Toner type | First embodiment | Conventional Example |
|---|---|---|
| A | −7 | −3 |
| B | −9 | −4 |
| C | −6 | −3 |

The toner types A, B and C are the three types of developers that were employed.

The toner A is the above described toner used for this embodiment. That is, 60 weight % of magnetite and 1 weight % of a monoazo dye, which is a metal complex salt and which is a negative charge control material, were mixed in a bonding resin, which contains a styrene acryl copolymer as a primary element, to form an insulating developer having a volume resistivity of about $10^{13}$ Ω·cm, and 0.8 weight % of hydrophobic silica particles were added to the developer to the weight of the developer in order to provide flowability.

The toner B is substantially the same as the toner A, except that the content of the monoazo dye, which is the metal complex salt and which is the negative charge control member, was changed to 1.1 weight %.

For the toner C, the metal complex salt content was also changed and was 0.9 weight %.

As is apparent from Table 1, since compared with the conventional example a large amount of negative charges were provided for the residual developer, appropriate charges can be provided for the developer. These results were obtained by performing the following operation.

In this embodiment, while the residual developer is carried on the charge roller 2, it passes through the contact nip e between the charge roller 2 and the nip forming member 6. At this time, since the charge accelerating particles m on the surface of the charger roller 2 are rubbed strongly against the developer 31, charging is generated by friction. Since the same charging is performed as in the developing device 3, appropriate negative charges are provided for the developer 31. Since the charge accelerating particles m include a number of charges having the opposite polarity, i.e., a number of positive charges, an attractive force is exerted by the charge roller 2, which has a negative polarity, so that the coating of developer 31 can more securely adhere to the charge roller 2.

On the contrary, in the conventional example where the nip forming member 6 is not provided, in the interval between the point where the residual developer adheres to the charge roller 2 and the point whereat it returns to the photosensitive member 1, no nip is available to accelerate the contact between the charge accelerating particles m and the developer 31. Therefore, the charge accelerating particles m unsatisfactorily contact the developer 31, and appropriate charges can not be provided for the developer 31.

The present embodiment and the conventional example were compared in the following manner to examine the differences in the collection of residual toner by the developing device 3.

A solid black image having a size equivalent to one revolution of the photosensitive member 1 was printed, and then, the image was changed and a solid white image was printed. Immediately after this, the volume of the developer 31 remaining on the photosensitive member 1 after passing the development position c (developing device 3) was examined. The amount of the developer 31 attached to the photosensitive member 1 after passing the development position c can be represented as (1) and (2):

(1): residual developer that can not be collected by the developing device, and (2): a fogging element constituting a background element originally generated by the developing device 3.

Since the fogging element in (2) is the same for both the embodiment and the conventional example, substantially, a difference of (1)+(2) between the embodiment and the conventional example=a difference of (2) between the embodiment and the conventional example can be established.

That is, the difference of the volume of the developer 31 that is attached to the photosensitive member 1 after the development position has been passed represents the difference in the residual developer collection functions.

The measurement of the amount of residual developer was conducted in the following manner. After the transfer position was passed, Mylar tape (poly(ethylene terephthalate) tape) was applied to the surface of the photosensitive member 1 to remove the developer 31 adhering thereto. Thereafter, the Mylar tape was attached to a white sheet of paper, and the amount of reflected fog on the Mylar tape was measured by using a fogging volume measurement device, TC-6DS, made by Tokyo Denshoku Co., Ltd. In this instance, the reading obtained for the amount of reflected fog when the Mylar tape was attached to the white paper was measured and recorded as the standard amount of reflected fog. Further, the substantial amount of the reflected fog was obtained by subtracting a measured value from the standard amount of the reflective fog. In this case, as the paper was whiter, i.e., the amount of residual developer was small, a small measured value was obtained.

From the measurements, it was determined that the fogging amount for the conventional example was 1.5 while the fogging amount for this embodiment was 0.9, and it was thus found that the developer collection function provided by this embodiment was superior.

Further, during a comparison of general character printing with the conventional example for this embodiment, it was found that image fogging due to residual toner does not appear in the white portion of a printed image, and conductivity and image quality can be improved.

As described above, in the image forming apparatus in this embodiment, which performs a charging process whereby the charge accelerating particles m are inserted between the charge roller 2 and the photosensitive member 1, the charge roller 2 is brought into contact with the nip forming member 6, and a nip e is formed in addition to the nip formed between the charge roller 2 and the photosensitive member 1. Thus, appropriate charges can be provided for residual developer by rubbing the charge accelerating particles m against the developer 31, so that the residual developer collection function of the developing device 3 is improved and a satisfactory image quality can be obtained.

In this embodiment, only one nip forming member 6 is employed; however, multiple nip forming members 6 may be provided. Further, the material of the nip forming member 6 is not limited to the one used in this embodiment.

(Embodiment 2)

Figure 2:
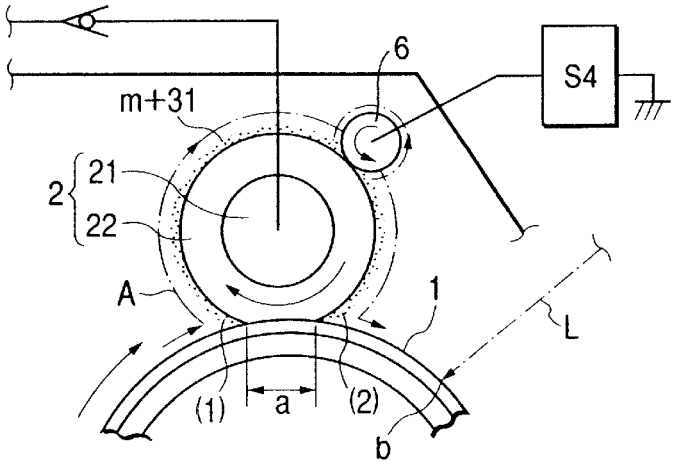
FIG. 2 is a schematic diagram showing the specific configuration of the essential portions of an image forming apparatus according to a second embodiment of the present invention.

According to a second embodiment, the nip forming member 6 for the charge roller 2 in the first embodiment is replaced with a conductive metal rod 6, as shown in FIG. 2. A voltage having the same polarity as the normal polarity of the developer 31, i.e., a negative voltage in this embodiment, is applied to the metal rod 6 by a bias voltage power source S4.

Since the remainder of the configuration is the same as that in the first embodiment, no further explanation will be given.

The metal rod 6 in this embodiment, which is a nip forming member, is formed of cylindrically shaped aluminum, and its rotation is coupled with that of the charge roller 2, which it contacts. In this embodiment, −900 V is applied to the metal rod 6 by the bias voltage power source S4.

In this embodiment, the metal rod 6 is conductive, and a negative voltage, which has the same normal polarity as the developer 31, is applied to it. Since the charge accelerating particles m have an intermediate resistance, friction charging as well as charge injection can be performed for the residual developer. Thus, charges can more appropriately be provided for the residual developer.

Since the metal rod 6 has a more negative potential than the charge roller 2, the residual developer that has a positive polarity, which is the opposite of the normal charge polarity, is moved from the surface of the charge roller 2 to the surface of the metal rod 6. Then, the polarity of the residual developer is changed to the appropriate negative polarity through friction with the charge accelerating particles m, and is returned to the surface of the charge roller 2 and thereafter to the surface of the photosensitive member 1. Therefore, the residual developer to be returned to the surface of the photosensitive member 1 can be better normalized.

(Embodiment 3)

Figure 3A:
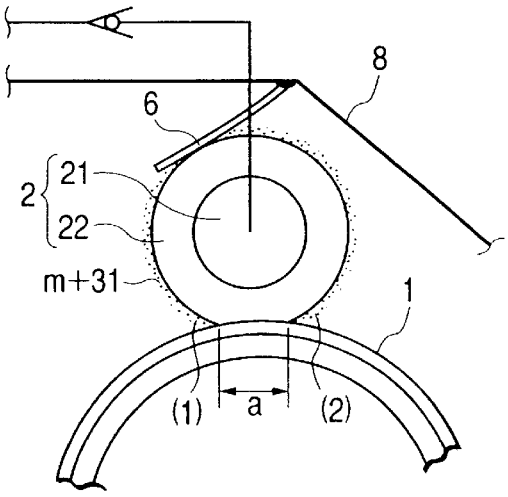
FIGS. 3A and 3B are schematic diagrams showing the specific configurations of the essential portions of an image forming apparatus according to a third embodiment of the present invention.
Figure 3B:
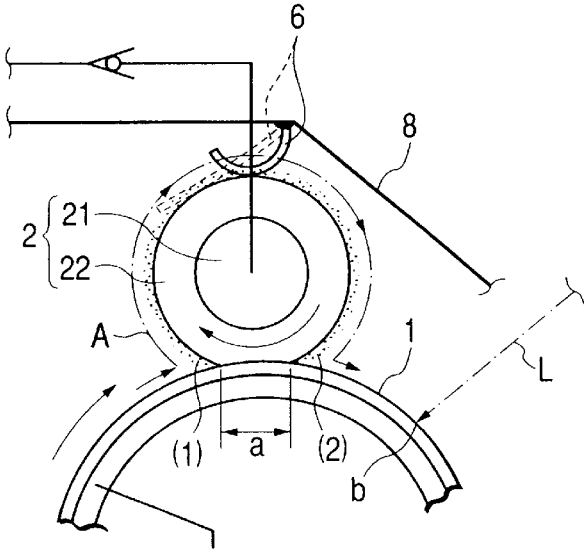

According to a third embodiment, the nip forming member 6 having a sheet shape in the first embodiment is arranged so that it contacts the charge roller 2 in the direction (a counter direction) opposite to the rotation direction of the charge roller 2, as shown in FIG. 3A. With this arrangement, while the charge roller 2 is rotated, as shown in FIG. 3B, the contact pressure exerted between the charge roller 2 and the nip forming member 6 is increased by the deflection reaction force of the nip forming member 6.

While the same material as in the first embodiment is used for the nip forming member 6 in this embodiment, the support provided for the nip forming member 6 is different. Specifically, only one end of the nip forming member 6 is fixed, and the other end contacts the charge roller 2 upstream in the rotational direction. Thus, when the charge roller 2 is rotated, the nip forming member 6 engages the charge roller 2, and the contact pressure is increased (FIG. 3A to FIG. 3B). When the charge roller 2 is halted, the nip forming member 6 is returned from the bent position, and the contact pressure is returned to a low pressure state (FIG. 3B to FIG. 3A).

In this embodiment, only when the charge roller 2 is rotated is the pressure increased at the portion whereat the nip forming member 6 contacts the charge roller 2. Therefore, the contact pressure is increased only during the time an operation (printing) is being performed to increase the frequency whereat the developer 31 and the charge accelerating particles m contact each other so that appropriate charges can be applied to the residual developer. Further, since the contact pressure between the charge roller 2 and the nip forming member 6 is reduced during the time no operation (no printing) is being performed, deformation of the charge roller 2 can be prevented.

A nip forming member 6 of a roller type, as in the second embodiment, may be arranged relative to the charge roller 2, using a cam mechanism or a solenoid mechanism, so as to bring it into contact with or to separate it from the charge roller 2. With this arrangement, the mechanisms may be controlled so that during operation a predetermined contact pressure is applied to the nip forming member 6 and holds it against the charge roller 2, and that, when no operation is being performed, a reduced contact pressure is applied to the nip forming member 6 to hold it less tightly against the charge roller 2 or to separate it from the charge roller 2.

(Others)

1) The rotary member that serves as the contact charge member is not limited to the charge roller in these embodiments, and other material having another shape, such as a fur brush, felt or cloth, may be employed. Further, these materials may be laminated to obtain more appropriate elasticity (flexibility) and conductivity. A flexible member, such as a fur brush having elastic piles, may also be employed, and can be, for example, a fur brush roller wherein fiber piles (e.g., Rec made by Unitika Ltd.) having a length of 3 mm and having an adjusted resistance are embedded at density of 155 pieces/mm$^2$ and are securely wound around a metal core of $\phi$6 mm. Not only a roller, but also a rotary belt can be employed as the charge roller.

2) The charge bias voltage or the development bias voltage to be applied to the contact charge member and the developing sleeve may be obtained by superimposing a direct-current voltage with an alternating voltage (alternating-current voltage).

An arbitrary waveform, such as sine wave, a rectangular wave or a triangle wave, can be employed for an alternating voltage. Further, a rectangular wave formed by periodically turning on or off the direct-current power source may be employed. A bias voltage having a value that is periodically changed can be employed as the waveform for the alternating voltage.

3) The image exposure means, as in the embodiments for forming an electrostatic latent image is not limited to laser scanning exposure means for forming a digital latent image. So long as a latent image corresponding to image data can be formed, a general analog image exposure unit, another light emitting element, such as an LED, or a combination of a light-emitting device, such as a fluorescent lamp, and a liquid crystal shutter, may be employed.

The image bearing member may be an electrostatic recording dielectric member. In this case, when the surface of the dielectric member is primarily uniformly charged at a predetermined polarity and potential, it can be selectively de-electrified by charge elimination means, such as a charge elimination needle head or an electron gun, so as to form a target electrostatic image.

4) In the embodiments, the inverse developing device using magnetic one-component toner has been employed: however, the structure of the developing device is not particularly limited, and a normal developing device may be employed.

Generally, the methods for developing an electrostatic latent image are roughly sorted into four types; a method (one-component, non-contact phenomenon) whereby non-magnetic toner is coated using a blade on a developer holding and carrying member, such as a sleeve, or magnetic toner is coated on the developer holding and carrying member by magnetic force, and whereby the toner is transported and used to develop an electrostatic latent image without contacting an image bearing member; a method (one-component contact phenomenon) whereby the toner that is coated on the developer holding and carrying member as in the above first method is used to contact the image bearing member to develop an electrostatic latent image; a method (two-component contact phenomenon) whereby a mixture of toner particles and a magnetic carrier is carried as a developer (two-component developer) by magnetic force and is brought into contact with the image bearing member to develop an electrostatic latent image; and a method (two-component non-contact phenomenon) whereby the two-component developer is used to develop an electrostatic latent image without contacting the image bearing member.

5) The transferring means can be a roller transferring means or a belt transferring means.

6) The image forming apparatus may employ an intermediate transferring member, such as a transferring drum or a transferring belt, to form not only a monotone image, but also a multi-color or full-color image using multiplex transferring.

7) The image forming apparatus is not limited to the cleaner-less type, the apparatus may include a cleaner.

What is claimed is:

1. An electrifier for electrifying a member to be charged, the member to be charged carrying a developer having a normal polarity, comprising:

a charge rotary member that forms a first nip with the member to be charged, to charge the member to be charged, and that holds and carries charge particles to the first nip; and a nip forming member that forms a second nip with said charge rotary member, wherein a voltage having a polarity the same as the normal polarity of the developer is applied to said nip forming member.

2. An electrifier according to claim 1, wherein said nip forming member accelerates, at the second nip, contact between the charge particles and the developer, and the developer is adhered from the member to be charged to said charge rotary member and held on said charge rotary member.

3. An electrifier according to claim 2, wherein the developer is charged to the normal polarity by friction between the developer and the charge particles.

4. An electrifier according to claim 3, wherein the charge particles are electrified with a polarity opposite the polarity of said charge rotary member by friction between the charge particles and the developer.

5. An electrifier according to claim 2, wherein the charge particles are electrified with a polarity opposite the polarity of said charge rotary member by friction between the charge particles and the developer.

6. An electrifier according to claim 1, wherein said charge rotary member is a roller.

7. An electrifier according to claim 1, wherein said charge particles are conductive.

8. An electrifier according to claim 1, wherein said nip forming member is shaped like a sheet.

9. An electrifier according to claim 8, wherein said nip forming member is provided with a leading end spaced from said charge rotary member.

10. An electrifier according to claim 8, wherein a voltage having the same polarity as the normal polarity of the developer is applied to said charge rotary member.

11. An electrifier according to claim 1, wherein said charge rotary member has a peripheral speed differing from the peripheral speed of said member to be charged.

12. An electrifier according to claim 1, wherein at the first nip said charge rotary member is rotated in a direction opposite that of the member to be charged.

13. An electrifier according to claim 1, wherein on the surface of said charge rotary member a foaming material is included.

14. An image forming apparatus comprising:

an image bearing member that bears a developer having a normal polarity;

a charge rotary member that forms a first nip with said image bearing member, to charge said image bearing member, and that holds and carries charge particles to the first nip; and a nip forming member that forms a second nip with said charge rotary member, wherein a voltage having a polarity the same as the normal polarity of the developer is applied to said nip forming member.

15. An image forming apparatus according to claim 14, wherein said nip forming member accelerates, at the second nip, contact between the charge particles and the developer, and the developer is adhered from said image bearing member to said charge rotary member and held on said charge rotary member.

16. An image forming apparatus according to claim 15, wherein the developer is charged to the normal polarity by friction between said developer and said charge particles.

17. An image forming apparatus according to claim 15, wherein said charge particles are electrified with a polarity opposite to the charge polarity of said charge rotary member by friction between said charge particles and said developer.

18. An image forming apparatus according to claim 15, wherein the charge particles are electrified with a polarity opposite the charge polarity of said charge rotary member by friction between said charge particles and said developer.

19. An image forming apparatus according to claim 14, wherein said charge rotary member is a roller.

20. An image forming apparatus according to claim 14, wherein said charge particles are conductive.

21. An image forming apparatus according to claim 14, wherein said nip forming member is shaped like a sheet.

22. An image forming apparatus according to claim 21, wherein said nip forming member is provided with a leading end spaced from said charge rotary member.

23. An image forming apparatus according to claim 21, wherein a voltage having the same polarity as the normal polarity of the developer is applied to said charge rotary member.

24. An image forming apparatus according to claim 14, wherein said charge rotary member has a peripheral speed differing from the peripheral speed of said image bearing member.

25. An image forming apparatus according to claim 14, wherein at the first nip said charge rotary member is rotated in a direction opposite that of said image bearing member.

26. An image forming apparatus according to claim 14, wherein on the surface of said charge rotary member a foaming material is included.

27. An image forming apparatus according to claim 14, wherein, when said charge rotary member is halted, a contact pressure between said charge rotary member and said nip forming member is greater than a contact pressure when said charge rotary member electrifies said image bearing member.

28. An image forming apparatus according to any one of claims 13–17 and 19–25, further comprising:

electrostatic image forming means, for forming an electrostatic latent image on said image bearing member that is electrified by said charge rotary member; and developing means, for developing said electrostatic latent image using a developer.

29. An image forming apparatus according to claim 28, wherein said developing means is capable of collecting said developer on said image bearing member.

30. An image forming apparatus according to claim 28, wherein said developing means is capable of collecting said developer on said image bearing member at the same time as said electrostatic latent image is being developed.

* * * * *

UNITED STATES PATENT AND TRADEMARK OFFICE

CERTIFICATE OF CORRECTION

PATENT NO. : 6,615,010 B2
DATED : September 2, 2003
INVENTOR(S) : Jun Hirabayashi et al.

It is certified that error appears in the above-identified patent and that said Letters Patent is hereby corrected as shown below:

Column 1,
Line 58, “can not” should read -- cannot --.

Column 3,
Line 7, “developer.” should read -- developer, --.

Column 4,
Line 39, “of a” should read -- of: --.

Column 8,
Line 10, “As is” should read -- As --.
Line 32, “particles” should read -- particles m, --.

Column 9,
Lines 37 and 52, “can not” should read -- cannot --.

Column 14,
Line 8, “claim 15,” should read -- claim 16, --.
Line 46, “claims 13-17 and 19-25,” should read -- claims 14-21 and 24-27, --.

Signed and Sealed this

Eleventh Day of May, 2004

JON W. DUDAS
*Acting Director of the United States Patent and Trademark Office*